United States Patent [19]

Groen

[11] 4,361,111

[45] Nov. 30, 1982

[54] GOLF BALL DRY RACK

[76] Inventor: Henry J. Groen, 899 Ashburn St., Herndon, Va. 22070

[21] Appl. No.: 334,019

[22] Filed: Dec. 23, 1981

[51] Int. Cl.[3] ..... B05C 13/02

[52] U.S. Cl. ..... 118/503; 15/268

[58] Field of Search ..... 118/503, 500, 502; 15/268; 211/14; 248/121, 316 R; 294/19 A

[56] References Cited

U.S. PATENT DOCUMENTS

| | | | |
|---|---|---|---|
| 241,492 | 5/1881 | Howell | 211/14 X |
| 355,997 | 1/1887 | Joyce | 211/14 X |
| 1,229,428 | 6/1917 | Fabritius | 118/503 |
| 1,500,544 | 7/1924 | Brockley | 211/14 X |
| 1,514,529 | 11/1924 | Johnston | 211/14 X |
| 4,068,814 | 1/1978 | Anthony et al. | 118/503 X |

FOREIGN PATENT DOCUMENTS

| | | | |
|---|---|---|---|
| 914220 | 4/1945 | France | 211/14 |

*Primary Examiner*—John P. McIntosh
*Assistant Examiner*—Mary Beth Calligaris
*Attorney, Agent, or Firm*—David H. Semmes; Warren E. Olsen

[57] ABSTRACT

A disassemblable pallet or dry rack for supporting spherical objects, such as golf balls, during painting or coating. The rack includes a base, having a series of radially aligned perforations, and at least three elongate prongs having horizontal leg portions extensible through the perforations in the base and shank portions extending vertically above the base, so as to present at least three prongs engageable with the spherical surface. The rack may be used, also, for suspending the golf ball in an inverted position during "dip" painting or coating and in an upright position for drying.

8 Claims, 6 Drawing Figures

GOLF BALL DRY RACK

BACKGROUND OF THE INVENTION (1) Field of the Invention

A pallet or a rack for holding spherical objects, particularly a disassemblable rack used for holding a spherical object, such as a golf ball, in upright and inverted positions. For example, the rack may be used for holding a golf ball during spray painting and drying or inverting the golf ball for dipping within paint.

(2) DESCRIPTION OF THE PRIOR ART

HOWELL—U.S. Pat. No. 241,492

JOYCE—U.S. Pat. No. 355,997

BROCKLEY—U.S. Pat. No. 1,500,544

JOHNSTON—U.S. Pat. No. 1,514,529

The foregoing prior art is being discussed in a Prior Art Statement, being submitted, separately.

SUMMARY OF THE INVENTION

A disassemblable rack for suspending a spherical object, such as a golf ball, during painting or coating and drying.

The rack includes a base having a plurality of pairs of radially aligned perforations and at least three prong members extensible at their bottom leg portions through said perforations. The bottom leg portions define a tripod beneath said base. The median or shank portion of said legs define a hand grip and the curvate top portion of the prongs are vertically arrayed, so as to present three resilient prong ends engageable with the golf ball surface. A clasp is used to secure the shank portions in vertical array, while the individual legs extend through said base as a tripod and the curvate top portions resiliently engage a golf ball or spherical surface. The entire rack assembly may be disassembled and packaged within a single plane in a conventional blister pack or the like.

DESCRIPTION OF THE PREFERRED EMBODIMENTS

Figures 1, 2, 3, 4:
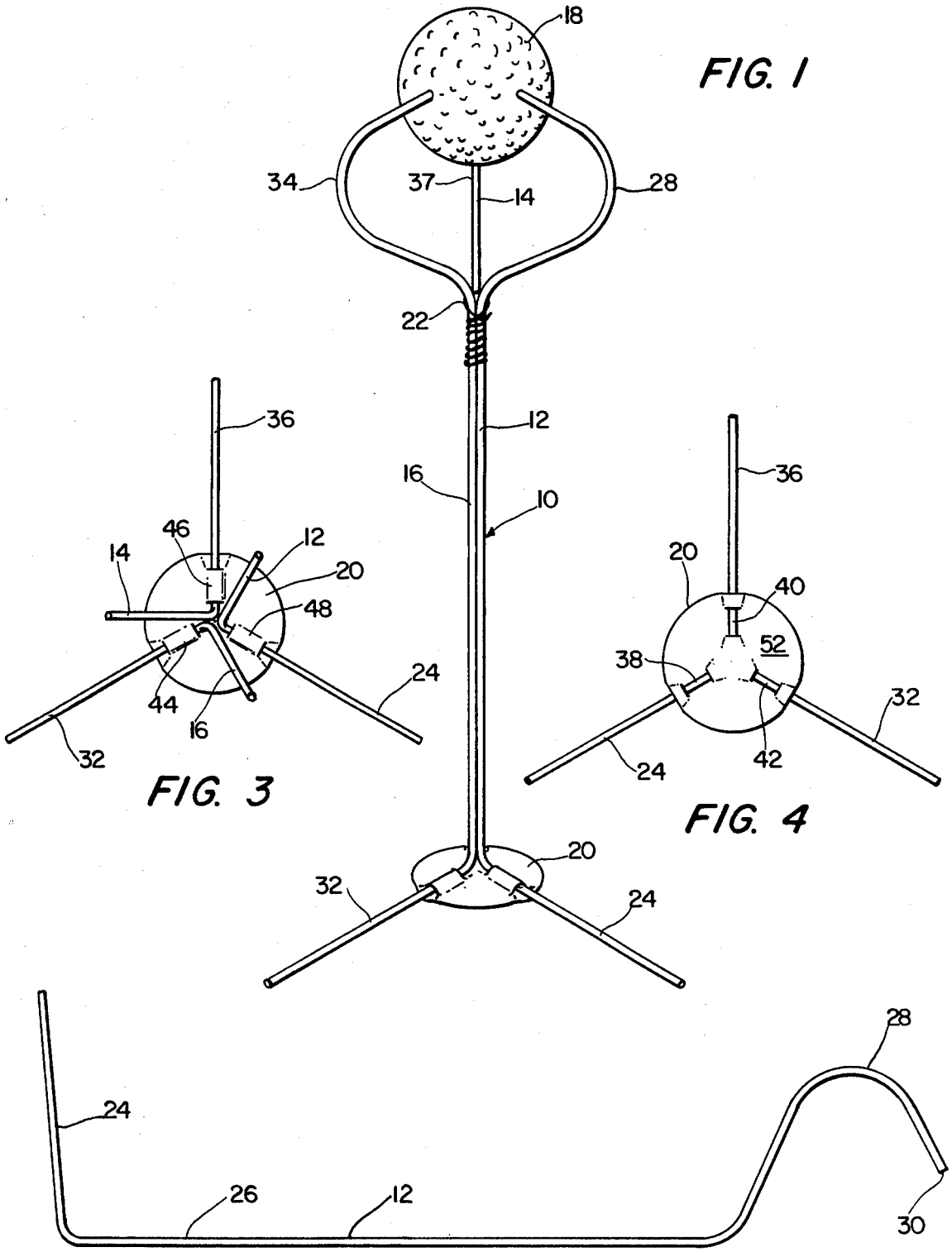
FIG. 1 is an elevational view of te dry rack, supporting a golf ball.
FIG. 2 is a side elevation of a single elongate prong.
FIG. 3 is a partially fragmentary top plan, showing extension of the prong legs through the series of radially aligned channels defined in the base.
FIG. 4 is a bottom plan of the base.

In FIG. 1 the golf ball dry rack assembly 10 is illustrated as including individual prong members 12, 14 and 16. In FIG. 2 prong member 12 is illustrated as further including vertically extending shank 26, horizontally extending leg 24 and curvate top portion 28, having a resilient, end 30. The individual prong 16 includes leg 32 and curvate top 34 and the individual prong 14 includes leg portion 36 and a curvate top 37.

Figure 5:
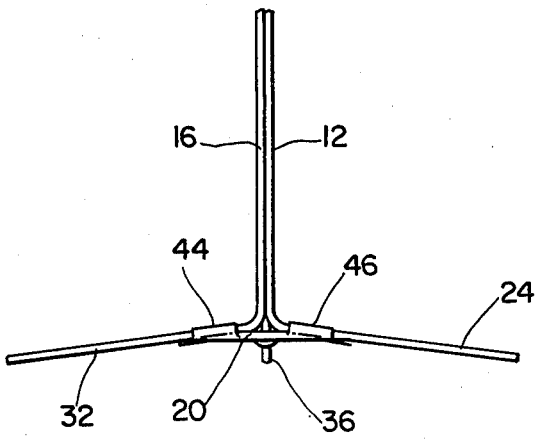
FIG. 5 is a fragmentary side elevation, showing the individual legs extending horizontally through the base, so as to form a tripod.

As illustrated in FIGS. 3, 4 and 5, the individual legs 24, 32 and 36 extend, respectively, through channels 48, 44 and 46, defined by pairs of radially aligned perforations in base member 20. Thus, individual leg segments 38, 40 and 42 are exposed at the bottom of base member 20, as illustrated in FIG. 4.

A resilient wire or clasping member 22 may be used to encircle the shank portions of prongs 12, 14 and 16, so as to secure these elements, as well as their curvate top portions in vertical array with respect to the golf ball or sphere being supported.

Figure 6:
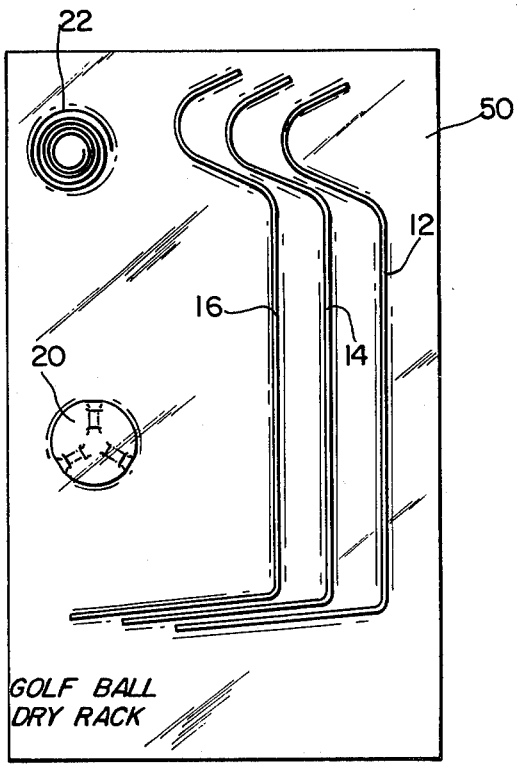
FIG. 6 is a top plan, showing disassembly of the rack, and conventional packaging with a flat blister pack.

It is intended, principally, that the disassemblable rack, shall be used as a personal item by the golfer who would purchase the flat blister package 50, illustrated in FIG. 6. The purchaser would then assemble the individual prong members, as illustrated in FIG. 1. A conventional golf ball 18 might then be suspended intermediate the prong ends, such that the golfer grasping the shank portions of the legs might hold the assembly upright for spray painting in "optic" orange, yellow or green or invert the entire assembly for dipping of the golf ball within an appropriate paint or coating. The entire assembly may then be returned to the upright position, illustrated in FIG. 1, such that the radially extending legs 24, 32 and 36 provide a tripod support, as the painted or coated golf ball 18 is permitted to dry.

Manifestly, the dry rack assembly is extremely economical to manufacture and package and provides a convenient utilitarian function. Various materials may be employed for the base, prong and clasping elements without departing from the spirit and scope of invention.

I claim:

1. A disassemblable rack for supporting a spherical object comprising:

A. a base member having at least three series of radially oriented perforations therein;

B. at least three elongate prongs adapted to circumferentially engage a spherical object at one end, while being supported in said base at the other end, each prong further including;

(i) a substantially horizontal leg, extending through said base perforations;

(ii) a vertically extending shank; and (iii) a curvate top portion, extensible radially inwardly, so as to engage the circumference of a spherical object; and C. a clasping means, engaging the exterior of said shank portions of said elongate prongs, so as to support said shanks and said curvate top portions in vertical array with respect to said base.

2. A disassemblable rack for supporting a spherical object, as in claim 1, each said curvate top portion having pointed ends, so as to engage complementally a conventional golf ball surface "dimples".

3. A disassemblable rack for supporting a spherical object, as in claim 1, said base having radially aligned channels, each channel being defined by a pair of said perforations for engaging said horizontally extending legs.

4. A disassemblable rack for supporting a spherical object, as in claim 3, said base including three such radially aligned channels, adapted, respectively, for engaging three horizontal leg portions.

5. A disassemblable rack for supporting a spherical object, as in claim 4, each prong being two dimensional in that said horizontal leg, shank and curvate top portion are aligned with the same plane.

6. A disassemblable rack for supporting a spherical object, as in claim 5, said channels defined in said base being radially aligned, such that outer portions of said horizontal legs define a tripod with respect to said base member.

7. A disassemblable rack for supporting a spherical object, as in claim 6, said base member being suspended vertically above said tripod defined by said legs.

8. A disassemblable rack for supporting a spherical object, as in claim 7, said curvate top portions being dimensioned to engage resiliently the exterior of a conventional golf ball.

* * * * *